United States Patent [19]

Schuh

[11] 4,363,568

[45] Dec. 14, 1982

[54] CONDUCTORS FOR A GUYED TOWER AND METHOD FOR INSTALLING SAME

[75] Inventor: Frank J. Schuh, Dallas, Tex.

[73] Assignee: Atlantic Richfield Company, Los Angeles, Calif.

[21] Appl. No.: 196,198

[22] Filed: Oct. 14, 1980

[51] Int. Cl.[3] ..... E02B 7/02

[52] U.S. Cl. ..... 405/227; 405/224

[58] Field of Search ..... 405/195, 224, 227, 228; 175/5, 9

[56] References Cited

U.S. PATENT DOCUMENTS

| | | | |
|---|---|---|---|
| 3,483,708 | 12/1969 | Marshall | 405/227 |
| 3,670,507 | 6/1972 | Mott et al. | 405/227 |
| 4,023,371 | 5/1977 | Bryant, Jr. | 405/224 X |
| 4,260,291 | 4/1981 | Young et al. | 405/224 X |

*Primary Examiner*—David H. Corbin

*Attorney, Agent, or Firm*—Drude Faulconer

[57] ABSTRACT

Conductors for use with a guyed tower offshore platform and a method for installing the conductors on the guyed tower. A conductor sleeve, e.g. a length of heavy-walled casing, is secured in a retracted position within at least the lowermost conductor guide of each set of vertical aligned conductor guides on the guyed tower. The guide sleeves are lowered with the guyed tower as the guyed tower is installed on location in a body of water. The sleeves are then released and are driven or otherwise penetrated into marine bottom to a depth equal to or preferably below the center of rotation of the guide tower. A conductor is then passed downward through its respective guides and guide sleeve and is driven to refusal in the marine bottom. By providing a heavy-wall sleeve which spans the interval between the lowermost guide and the center of rotation, any deflection in the conductor caused by the rotation of the guyed tower is spread over a greater length than that which would normally occur in a conventionally installed conductor, thereby insuring the conductor of the present invention will stay within acceptable curvature and stress limits required in normal drilling and/or production operations.

8 Claims, 6 Drawing Figures

CONDUCTORS FOR A GUYED TOWER AND METHOD FOR INSTALLING SAME

BACKGROUND OF THE INVENTION

The present invention relates to offshore structures and more particularly relates to a method and apparatus of providing a "guyed tower" offshore structure with conductors which are capable of staying within acceptable curvature limits when the longitudinal axis of said guyed tower rotates from the vertical.

As the production of hydrocarbons from marine deposits moves into deeper and more hostile waters, the problems associated with providing the offshore structures required for drilling and producing these hydrocarbons obviously increase. Recently, various offshore structures have been proposed as possible alternatives for the commonly-known and widely used fixed platform; especially in those offshore regions where the use of a fixed platform is technically and/or economically infeasible, e.g. extreme water depths, hostile surface conditions, etc.

One such proposed structure is one which is commonly referred to as a "guyed tower" platform which is basically a trussed structure having substantially uniform cross-sectional dimensions throughout its length. Although other geometric configurations may be used, the main truss of a typical guyed tower normally has four equally spaced legs connected together primarily with X-bracing members. The main truss of the tower rests on the marine bottom and extends upward to a point above the surface. A drilling/production deck is affixed onto the top of the main truss above the normal wave heights of the water body. The main truss is maintained in a substantially vertical position in the water by means of a plurality of guylines which are positioned symmetrically about the truss. For a more complete description of a typical guyed tower offshore structure, reference is made to a paper "A New Deepwater Offshore Platform—The Guyed Tower", L. D. Finn. Paper No. 0TC 2688, presented at the Offshore Technology Conference, Houston, Texas, May 3–6, 1976.

In using a guyed tower such as described above to drill and/or produce underwater formations, conductor conduits will normally be run through guides on the tower after the tower has been installed on location. As understood in the art, these conductors extend from the surface and are driven to refusal or otherwise penetrated to a desired depth in the marine bottom. A well is then drilled and/or completed through each of these conductors by techniques, e.g. directional drilling, well known by those skilled in the art.

Due to the inherent compliancy of the guyed tower, the longitudinal axis of the guyed tower will tilt or rotate from vertical whenever the tower experiences certain surface conditions, e.g. high wave and wind action. This tilting or rotation of the tower about its "center of rotation" (to be defined below) can seriously affect the conductors near the marine bottom if the rotation exceeds certain, relatively small limits and the center of rotation is below the depth of the competent soils of the marine bottom. For example, analysis of a typical guyed tower reveals that tower rotation of one-and-a-half degrees from the vertical will cause excessive well curvatures (i.e. in access of the accepted limit of 6 degree curvature per 100 feet) and conductor stresses in conventionally supported wall conductors if the center of rotation of the tower is located at or below the depths of the competent soils of the marine bottom. "Competent soils" as used here is defined as those soils which are sufficiently competent to resist any substantial lateral movement of the conductors when the longitudinal axis of the tower rotates from vertical. If the center of rotation of the guyed tower is near or below the depth of the competent soils, rotation of the tower will generate an undesirable S-shaped deflection in a conventionally installed well conductor in that interval of the conductor which lies between the lowermost conductor guide on the tower and the competent soil levels. The greater the depth of the center of rotation, the greater the lateral movement of the tower at the marine bottom will be, thereby causing higher conductor curvatures and stresses.

Of course, in some instances, an extremely heavy and rigid conduit, e.g. extremely thick-walled casing, can be used to form the entire length of the conductor to provide additional strength in resisting bending thereby reducing the conductor curvature and stress problems developed by the rotation of the tower. However, in addition to the obvious expense and handling problems involved with installing the required lengths of such heavy conduit, the weight of the conductor, itself, becomes a problem in that the vertical weight load on the conductor may cause failure due to buckling or the like. Therefore, this does not appear to be the solution needed.

SUMMARY OF THE INVENTION

The present invention provides well conductor conduits (commonly called "conductors") for carrying out drilling and/or production operations from a typical guyed tower offshore structure which do not exceed acceptable stress and curvature limitations (i.e. 6 degrees or less curvature per 100 feet) whenever the longitudinal axis of said guyed tower rotates about a center of rotation which lies below the depth of the competent soils of the marine bottom and the method for installing said conductors on said guide tower.

In accordance with the present invention, a conductor sleeve comprised of a heavy, thick-walled casing is provided for each conductor at the lower end of the guyed tower which, once in position and upon rotation of the tower, serves as a laterally flexible substantially smooth curved transition for the conductor between the lowermost conductor guide on the guyed tower to a depth in the marine bottom which is at or preferably below the center of rotation. Since the conductor passes through its respective sleeve and conforms substantially to the curvature of the sleeve, any S-shaped deflection of the conductor which normally occurs in this interval of a conventionally installed conductor is eliminated or at least is spread over a much greater length which effectively reduces the maximum curvature. Also, by following the smooth curvature of the heavy-walled sleeve, the conductor stays well within the acceptable stress and curvature limitations required for drilling and/or production operations whenever the guyed tower experiences rotation due to surface conditions.

More particularly, an individual conductor sleeve is positioned within at least the lowermost conductor guide of each set of vertically spaced conductor guides on the main truss of the guyed tower. Each sleeve is held in a retracted position by a releasable means on the lowermost guide. The sleeves are lowered in their retracted positions with the truss as the guyed tower is installed. After the guyed tower is installed, the sleeves are released and driven or otherwise penetrated into the marine bottom to a depth equal to or preferably greater than the depth of the center of rotation of the guyed tower. Conductors, as needed, are then lowered through their upper conductor guides, through the sleeves, and then driven to refusal or otherwise sufficiently penetrated into the marine bottom to carry out drilling and/or production operations from the guyed tower. Each sleeve extends at least from above the lowermost guide to a point at or preferably below the center of rotation of the guide tower.

BRIEF DESCRIPTION OF THE DRAWINGS

The actual construction, operation, and the apparent advantages of the invention will be better understood by referring to the drawings in which like numerals identify like parts and in which.

DESCRIPTION OF THE PREFERRED EMBODIMENT

Figure 1:
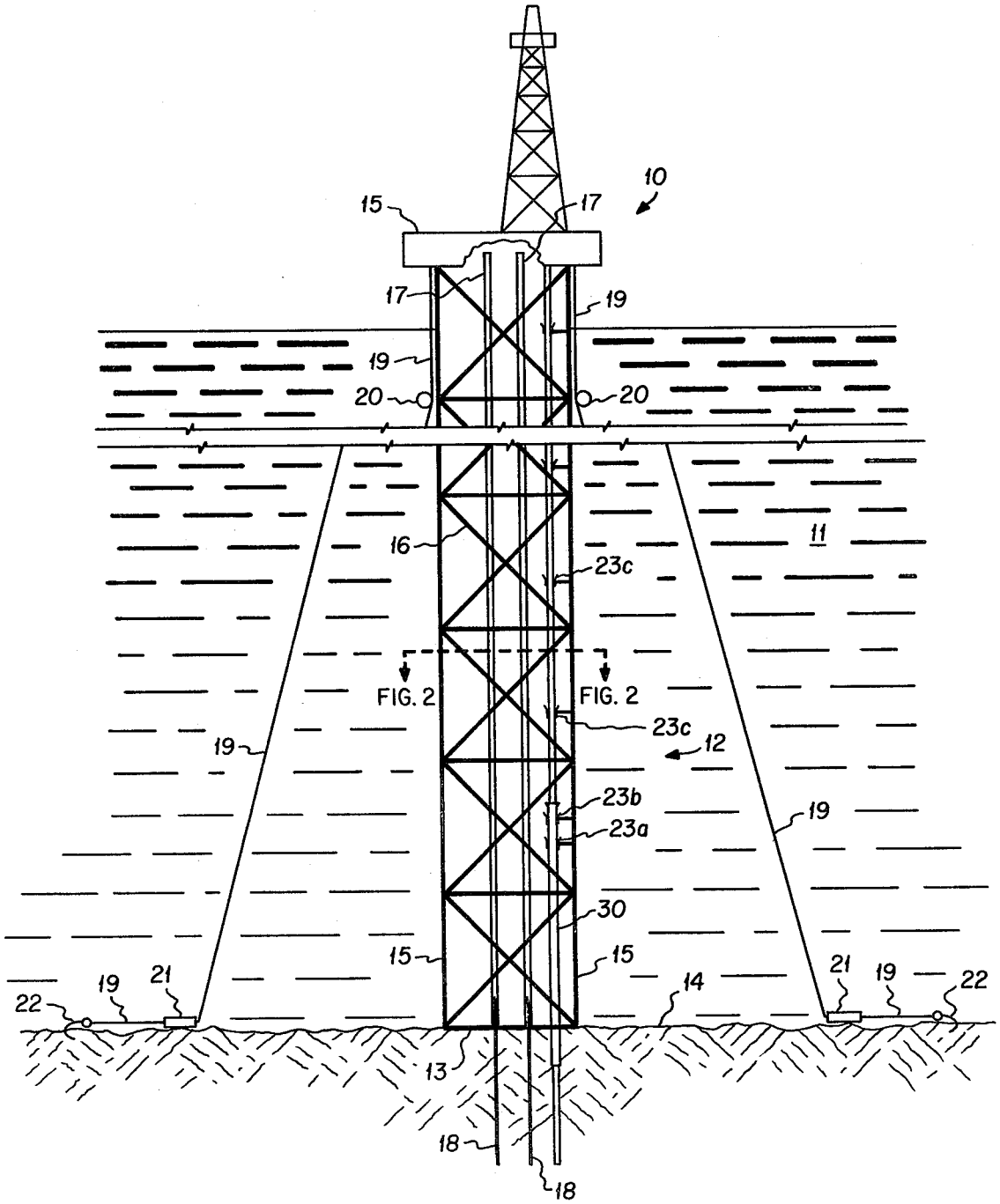
FIG. 1 is a perspective view of a typical guide tower in an operable position at an offshore location having conductors installed in accordance with the present invention.
Figure 2:
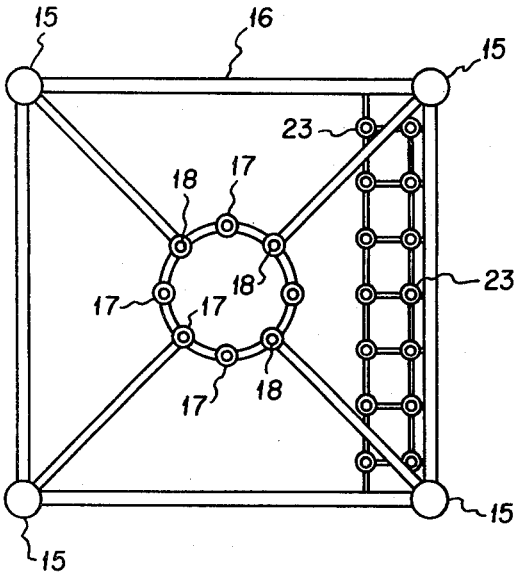
FIG. 2 is a cross-sectional view taken along section 2—2 of FIG. 1.

Referring more particularly to the drawings, FIG. 1 discloses the basic configuration of a typical guyed tower offshore structure 10 in position in a body of water 11. Guyed tower 10, as shown, is comprised of a main truss structure 12 which in turn is comprised of four legs 15 (FIG. 2) connected together by conventional X-bracing members 16. The bottom 13 of truss 12 rests on marine bottom 14 when guyed tower 10 is in an operable position. Deck 15 is affixed to the top of truss 12 from which drilling and/or production operations are carried out as understood in the art. Secured internally within truss 12 and extending throughout its length are a plurality of pile guide conduits 17. Piles 18 extend through conduits 17 from deck 15 are driven or otherwise penetrated into marine bottom 14 to a desired anchoring depth. As known in the art, piles 18 are secured to conduits 17 only at their respective upper ends near or at deck 15 so that although piles 18 do anchor truss 12 on location, guyed tower 10 still has a high degree of compliance to compensate for the forces exerted thereon by surface conditions.

Positioned around the perimeter of tower 10 are a plurality of guyed lines 19 (only two shown) which are attached at their upper ends to deck 15. Lines 19 extend vertically downward over a respective fairlead 20, then angularly (e.g. 60 degrees angle) downward to clump weight 21, and then along marine bottom 14 to anchor means 22. As understood in the art, guyed lines 19 (e.g. 10 to 20 in number) are arranged symmetrically around truss 12 to maintain tower 10 in a substantially vertical position in water 11 and to restore tower 10 to said vertical position when surface actions causes the longitudinal axis of guyed tower 10 to rotate therefrom.

In known guyed tower designs, a plurality of sets of conductor guides 23 are affixed within truss 12. Each set of conductor guides 23 is comprised of individual guides which are spaced at vertical intervals along truss 12 and are positioned in a vertical line parallel with the longitudinal axis of truss 12. An individual conductor conduit is passed downward through each guide of its respective set and is driven or otherwise penetrated to a substantial depth in marine bottom 14. A well is then drilled and/or completed through each set of conductors 23.

Figure 3:
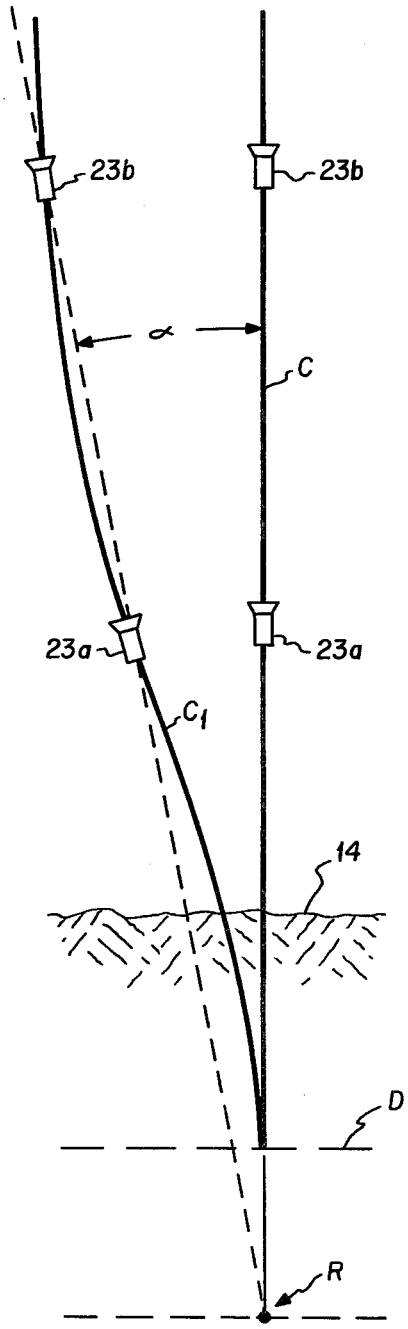
FIG. 3 is a schematic view depicting the curvature encountered by conventionally installed conductor when the longitudinal axis of a typical guide tower rotates about its center of rotation.

Referring now to FIG. 3, the effect which rotation of guyed tower 10 has on a conventionally installed conductor is schematically illustrated. The curvature and bending stresses on conductor (heavy line C) are affected by the following parameters: (1) depth of the center of rotation R of guyed tower 10, (2) magnitude of rotation (angle $\alpha$); and (3) the spacing between the lowermost conductor guides 23*a*, 23*b* and marine bottom 14. Of these parameters, the relative position of the center of rotation R is considered to be the most important. The center of rotation R is defined as that point about which the longitudinal axis of guyed tower 10 rotates when surface conditions cause lateral movement of the upper portion of guyed tower 10. Analysis indicates that even if angle $\alpha$ is as small as one-and-a-half degrees, excessive curvatures and stresses will develop in conventionally supported conductor C if the center of rotation R is at or below the depth D of laterally competent soils which is that depth below which the soils prevent any significant lateral movement of conductor C upon rotation of guyed tower 10. It can be seen that if conductor C is restrained from lateral movement at D, conductor C acts as a "pinned beam" between the center of rotation and guides 23*a*, 23*b*. This causes conductor C to experience an S-shaped deflection (as shown by $C_1$) between depth D and the lower guides 23*a*, 23*b*. Since such curvature is considered unacceptable in most drilling and/or production operations, it can be seen that conventionally installed conductors will experience severe problems when used with a guyed tower.

In accordance with the present invention, a stiff, heavy wall conductor sleeve 30 (e.g. 30 inch O.D. casing having 1½ to 2 inch wall thickness) is positioned within one or more of the lowermost conductor guides 23 on truss 12. As shown, conductor sleeve 30 is positioned through two guides 23*a*, 23*b*, although in some instances it may only be necessary to use the lowermost guide 23*a* while in other instances more than two guides may be used. Further, although only one conductor sleeve 30 is illustrated, it should be understood that an individual conductor sleeve 30 will be installed in the lowermost guides of each set of conductor guides 23 in the same manner as described.

Figure 4:
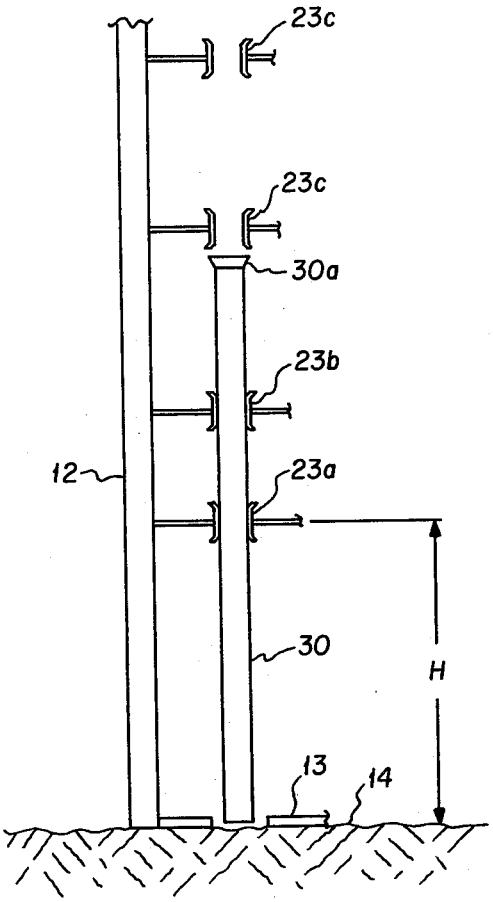
FIG. 4 is a partial view of the lower portion of the guyed tower of FIG. 1 with the conductor sleeve in a retracted position.
Figure 5:
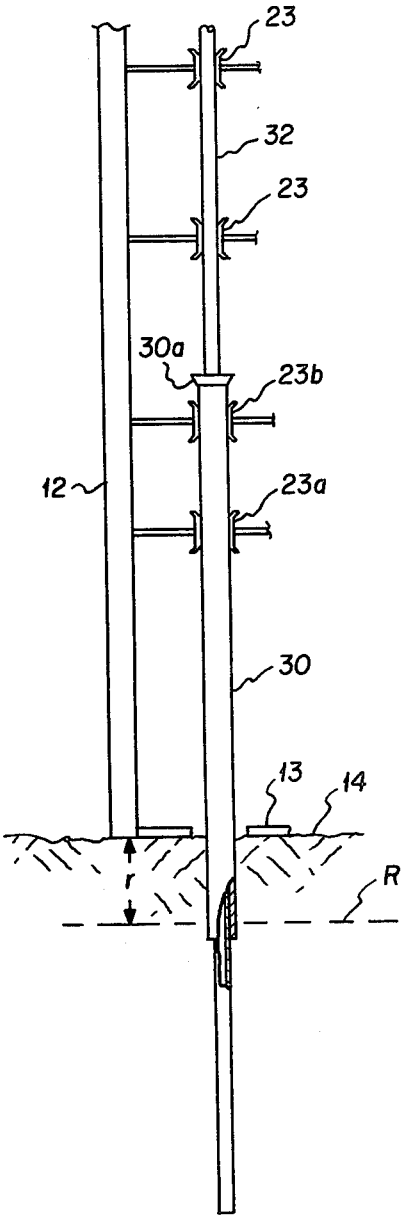
FIG. 5 is a partial view of the lower portion of the guyed tower of FIG. 1 with the conductor sleeve in an operable position.
Figure 6:
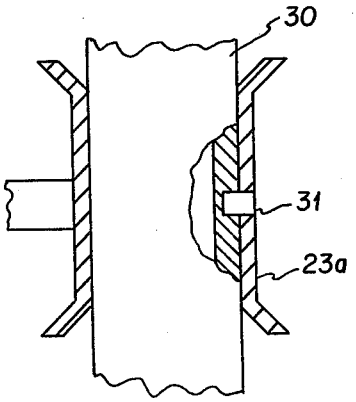
FIG. 6 is a sectional view of the lowermost conductor guide on the guyed tower of FIG. 1 illustrating a releasable means for holding the conductor sleeve in a retracted position.

Sleeve 30 which is funneled at its upper end 30*a* is originally positioned in guides 23*a*, 23*b* in a retracted position so the lower end of sleeve 30 is substantially adjacent the bottom 13 of truss 12. The length of sleeve 30 is such that sleeve 30, when in its retracted position, will extend upward from guide 23*b* for a distance greater than that distance r from marine bottom 14 to the center of rotation R (FIG. 4). Sleeve 30 is held in this retracted position by a releasable means 31 on either or both conductor guides 23*a*, 23*b*. As shown in FIG. 5, releasable means 31 is comprised of one or more shear pins (only one shown) but it should be understood that other means, e.g. hydraulic-actuated sleeves, collets, pins, or the like, can be used equally well.

All conductors sleeves 30 are positioned and secured in their respective guides and are lowered with truss 12 when guyed tower 10 is installed. A driving string (not shown) is then lowered and attached to the top of sleeve 30. Sleeves 30 are then released by releasing means 31 (e.g. shearing the shear pins or hydraulically retracting the latch, pins or the like) and are driven or otherwise penetrated to depth equal to or greater than the depth of the center of rotation R (FIG. 4). The driving string is then released from sleeve 30 and retrieved. The length of sleeve 30 is such that when it is driven to an operable position, its upper end 30*a* will not contact guide 23*b* but will be slightly above same. This allows sleeve 30 to be "free-standing" in relation to truss 12 and adds additional compliance to the conductors by providing limited, slidable movement of sleeve 30 within guides 23*a*, 23*b* whenever rotation of guyed tower 10 occurs.

An individual conductor 32 (e.g. 24 inch O.D.) is run downward from deck 15 through its respective set of conductor guides 23 as the conductor is needed.

It is understood that the internal diameters of guides 23 will be less than the internal diameters of lowermost guides 23*a*, 23*b*. As it passes downward, conductor 24 enters funneled end 30*a* of conductor sleeve 30, passes through sleeve 30, and is driven to refusal or otherwise penetrated into marine bottom to the depth necessary to carry out the desired drilling and/or completion operations.

As explained above, sleeve 30 when in an operable position will extend from above the lowermost guides 23*a*, 23*b* on truss 12 to a point at or preferably below the center of rotation R. Of course the center of rotation R will vary depending on the actual parameters (e.g. soil competency conditions of marine bottom 14, geometry of tower 10, rigidity of piles 18, etc.) involved in each guyed tower installed and will need to be determined after the particular parameters are known. Once the center of rotation R is determined and the strength characteristics of sleeve 30 are known (e.g. diameter, wall thickness, etc.) by using standard deflection and beam deflection calculations, the distance between the center of rotation R and the height H (FIG. 3) of lowermost guide 23*a* on truss 12 can be determined which is necessary to insure that sleeve 30 will stay with acceptable curvature limits when guyed tower 10 rotates about center of rotation R. The length of sleeve 30 would then be this length plus (1) the distance between guide 23*a* and 23*b*; (2) additional length (e.g. 5 feet) to insure end 30*a* will still lie above and out of contact with guide 23*b*; and (3) any additional length needed if sleeve 30 is to be driven below the center of rotation 30.

To further illustrate the present invention, beam deflection calculations were made for a 24-well, 1500 foot typical guyed tower having four legs spaced 100 feet apart. The center of rotation R was assumed to be 30 feet below marine bottom 14. If sleeve 30 comprises a 30 inch, O.D. casing having a one-and-a-half inch wall thickness, the lowermost guide 23*a* would be positioned 200 feet above the center of rotation or 170 feet from the bottom 13 of truss 12. Guide 23*b* would be spaced 60 feet from guide 23*a*. If it were desired to drive sleeve 30 to 45 feet below the center of rotation, the length of sleeve 30 would be 335 feet plus 5 feet to insure the upper end 30*a* was not in contact with guide 23*b* or 340 feet overall. If sleeve 30 comprises a 30 inch, O.D. casing having a two inch wall thickness, it increases the allowable distance from the center of rotation R to the lowermost guide 23*a* to 240 feet. Either of the sleeves of this example would maintain the curvature and stresses of conductor 32 well within acceptable limits, i.e. 6 degrees curvature per 100 feet. If sleeve 30 is pushed or driven to a depth below the center of rotation and the soils above this depth provide negligible lateral support for sleeve 30, the curvatures experienced by the conductors upon rotation of tower 10 will be even further reduced.

By providing heavy-walled sleeves 30 as described above which can span great unsupported lengths, it can be seen that the curvature is limited to acceptable levels because the distortion or deflection is spread over a much greater length than possible with conventionally installed conductors. Upon rotation, sleeves 30 assume a low, substantially smooth curvature deflection well within acceptable limits for drilling and/or productions operations. Since sleeves 30 act as guides for the lighter conductors, the conductors will also only experience the same smooth curvature as do their respective sleeves, thereby spreading the S-shaped deflection in the conductors over a much greater distance and insuring that the conductors will stay within the acceptable curvature limits.

I claim:

1. A method of installing at least one conductor for conducting drilling and/or production operations from a guyed tower offshore structure of the type having a main truss of substantially uniform cross-section throughout its length which is normally maintained in a vertical position within a body of water by a plurality of guylines, each connected at one end to the upper end of said main truss at points spaced about the periphery thereof and anchored at the other end thereof to the marine bottom, said main truss having at least one set of vertical spaced and aligned conductor guides thereon, said method comprising:

passing a conductor sleeve having a length less than the length of said main truss through at least the lowermost of said conductor guides and penetrating said conductor into the marine bottom on which said guyed tower offshore structure is positioned, said conductor sleeve, when in position, extending from above said at least lowermost conductor guide to a depth in said marine bottom at least equal to the depth of the center of rotation of said guyed tower.

2. A method of installing at least one conductor for conducting drilling and/or production operations from a guyed tower offshore structure of the type having a main truss of substantially uniform cross-section throughout its length which is normally maintained in a vertical position within a body of water by a plurality of guylines, each connected at one end to the upper end of said main truss at points spaced about the periphery thereof and anchored at the other end thereof to the marine bottom, said main truss having at least one set of vertical spaced and aligned conductor guides thereon, said method comprising:

securing a conductor sleeve having a length less than the length of said main truss in a retracted position within at least the lowermost of said conductor guides;

installing said guyed tower offshore structure onto a marine bottom of a body of water, said conductor sleeve being lowered in its retracted position with said at least lowermost conductor guide with said main truss;

releasing said conductor sleeve from said at least lowermost conductor guide;

penetrating said conductor sleeve into said marine bottom until said conductor sleeve extends from above said at least lowermost conductor guide to a depth in said marine bottom at least equal to depth of the center of rotation of the guyed tower offshore structure; and passing a conductor through said set of conductor guides, through said conductor sleeve, and to a depth in said marine bottom necessary for drilling and/or production operations.

3. The method of claim 2 wherein said conductor sleeve extends from above said at least lowermost conductor guide to a depth in said marine bottom below the depth of the center of rotation of said guyed tower offshore structure.

4. The method of claim 2 wherein said conductor sleeve extends from above the second lowermost of said conductor guides to a depth in said marine bottom equal to at least the depths of the center of rotation of said guyed tower offshore structure.

5. A guyed tower offshore structure for drilling and/or production operations comprising:

a main truss having a substantially uniform cross-section throughout its length resting on a marine bottom of a body of water;

guylines extending from said main truss to said marine bottom for normally maintaining said main truss in a vertical position in said body of water;

at least one set of vertically spaced and aligned conductor guides on said main truss;

a conductor sleeve having a length less than the length of said main truss, and releasable means for securing said conductor sleeve in a retracted position within at least the lowermost of said conductor guides.

6. A guyed tower offshore structure of claim 5 wherein said conductor sleeve has a length necessary to extend from above said at least lowermost conductor guide to a depth in said marine bottom equal to at least the depth of the center of rotation of said guyed tower offshore when said conductor sleeve is released from said at least lowermost conductor guide and is placed in an operable position.

7. A guyed tower offshore structure for drilling and/or production operations comprising:

a main truss having a substantially uniform cross-section throughout its length resting on the marine bottom of a body of water;

guylines extending from said main truss to said marine bottom for normally maintaining said main truss in a vertical position in said body of water;

at least one set of vertically spaced and aligned conductor guides on said main truss;

a conductor sleeve having a length less than the length of said main truss extending from above at least the lowermost conductor guide to a depth in said marine bottom equal to at least the depth of the center of rotation of the guyed tower offshore structure; and a conductor extending from the top of said main truss, through said set of conductor guides, through said conductor sleeve, and to a depth in said marine bottom necessary for drilling and/or production operation.

8. The guyed tower offshore structure of claim 7 wherein said conductor sleeve comprises:

a casing having a wall thickness greater than the wall thickness of said conductor.

* * * * *